US006296248B1

(12) United States Patent
Tanaka

(10) Patent No.: US 6,296,248 B1
(45) Date of Patent: Oct. 2, 2001

(54) SHEET CONVEYING APPARATUS

(75) Inventor: Yoshitaka Tanaka, Ibaraki-ken (JP)

(73) Assignee: Rico Kagaku Corporation, Tokyo (JP)

( * ) Notice: Subject to any disclaimer, the term of this patent is extended or adjusted under 35 U.S.C. 154(b) by 0 days.

(21) Appl. No.: 09/466,805

(22) Filed: Dec. 20, 1999

(30) Foreign Application Priority Data

Dec. 22, 1998 (JP) ..... 10-364930

(51) Int. Cl.[7] ..... B65H 9/00
(52) U.S. Cl. ..... 271/240; 271/198
(58) Field of Search ..... 271/240, 248, 271/234, 226, 198; 400/633

(56) References Cited

U.S. PATENT DOCUMENTS 2,938,723 * 5/1960 Paulson ..... 271/240
4,637,602 * 1/1987 Gavaghan et al. ..... 271/240
5,516,093 * 5/1996 Ballard et al. ..... 271/240
5,584,477 * 12/1996 Sakai ..... 271/240

FOREIGN PATENT DOCUMENTS

0078752 * 6/1981 (JP) ..... 271/240

* cited by examiner

*Primary Examiner*—H. Grant Skaggs
(74) *Attorney, Agent, or Firm*—Kanesaka & Takeuchi

(57) ABSTRACT

A sheet conveying apparatus for conveying a rectangular sheet includes conveying device for conveying the sheet while contacting a bottom surface of the sheet on a conveyance surface and a pair of elastic members disposed on two sides of the conveying device, the elastic members guiding the sheet while contacting respective side edge of the sheet when the sheet is conveyed by the conveying device so that a center line of the sheet coincides with a center line for conveyance.

5 Claims, 9 Drawing Sheets

SHEET CONVEYING APPARATUS

BACKGROUND OF THE INVENTION

1. Field of the Invention

The present invention relates to sheet conveying apparatuses, and more particularly to a sheet conveying apparatus capable of conveying a rectangular sheet in such a manner that a center line of the sheet relative to a conveyance direction of the sheet coincides with a predetermined center line for conveyance.

2. Description of the Related Art

In Japanese Patent Application No. 6-101236, the present applicant proposed an invention relating to a sheet discharging apparatus for a printing machine. This invention has been made public in Japanese Patent Publication No. 7-309496. This invention will be explained referring to FIGS. 3 to 8.

As illustrated in FIG. 3, an outlet 300*a* of a printing machine 300 is connected to an inlet of a sheet discharging apparatus 101 through a sheet conveying apparatus 100. The sheet conveying apparatus 100 has plural endless belts driven by a conveying motor. A post card as a sheet is printed by the printing machine 300, and conveyed by the sheet conveying apparatus 100, and then received in the sheet discharging apparatus 101. Ink on the post card as received is dried while the card is supported and conveyed in the sheet discharging apparatus 101. Then, the post card is dropped onto a tray 116 situated in a lower part of the sheet discharging apparatus 101, and stored therein.

As illustrated in FIG. 5, the sheet conveying apparatus 100 includes a conveying surface 102 for conveying a sheet. In the center of the conveying surface 102, an opening 103 is formed along a conveying direction. That is, two sheet guiding plates are situated along a direction perpendicular to the conveying direction at a predetermined distance away from each other, thereby forming the conveying surface 102. The distance between the two sheet guiding plates can be optionally adjusted. In the opening 103, sheet conveying means is situated. The sheet conveying means 103 includes a pair of pulleys 104 and three belts connecting the pulleys. The belts are parallel to each other. Upper surfaces of the belts contacting a bottom surface of the sheet 106 coincides with the conveying surface 102. The belts 105 convey the sheet 106 with the upper surfaces thereof contacting the bottom surface of the sheet 106.

As illustrated in FIG. 4, the sheet discharging apparatus 101 has, as a main body, a frame 110 approximately in a form of a box. On an upper portion of the frame 110, two shafts 111 are situated along two side edges of the sheet to be conveyed, respectively. Each shaft 111 has supporting means 112 comprising four plates.

In the frame 110, a pair of upper and lower driving axes 113 is situated below each of the shafts 111. The driving axes 113, 113 of the same pair are connected by two belts 114. Each of the belts 114 has many receiving flaps 115 formed at a predetermined distance therebetween. As illustrated in FIG. 6, in a view perpendicular to the conveying direction, a distance between the right and the left belts 114, 114 is relatively wide in an upper portion and approximately coincides with a width of the sheet 106 in a lower portion.

A discharging tray 116 is drawably situated at the bottom of the frame 110.

The sheet 106, after being printed thereon by a not-shown printing machine, is discharged to the outside of the machine. The printed sheet 106 discharged from the printing machine is placed on the conveying surface 102 of the sheet conveying apparatus 100. The belt 105 moves while contacting the bottom surface of the sheet 106, thereby moving the sheet 106 along the conveying surface 102. The sheet is positioned while being guided by the sheet guiding plates at both side edges thereof, and conveyed to the sheet discharging apparatus 101. The sheet 106 is supported by the pair of the supporting means 112 of the sheet discharging apparatus 101. Upon rotation of the shaft 111, the sheet is downwardly conveyed and held by the receiving flaps 115 therebetween. Moving belts 114 convey the sheet downwardly. Ink printed on the sheet is dried during conveyance, and then the sheet is dropped onto the discharging tray 116 to be stacked therein.

As illustrated in FIG. 5, a center line L1 of the rectangular sheet 106 as discharged from the printing machine is parallel to the conveying direction, but this does not necessary coincide with a center line L2 of the sheet conveying apparatus 100 for conveyance. Conventionally, if the distance between the sheet guiding plates of the sheet conveying apparatus 100 is arranged to coincide with the width of the sheet 106, the center line L1 of the sheet 106 in the conveyance direction is to coincide with the center line L2 for conveyance while the sheet 106 is conveyed to pass through the distance. However, as a matter of fact, it is difficult to make the center line L1 in the conveyance direction of the sheet 106 to coincide with the center line L2 precisely by using the sheet guiding plates.

Namely, the distance between the sheet guiding plates is adjustable according to the width of the sheet 106; therefore, it is inevitable that irregularity may occur in positioning the sheet guiding plates due to such adjustability. Hence, in the case where a sheet of a size is conveyed, it is difficult to always place the sheet guiding plates in constant positions determined according to the size. Further, the distance between the sheet guiding plates must be adjusted fairly broader than the width of the sheet to allow the sheet to pass through the distance. Thus, in the conventional sheet conveying apparatus, the distance between the sheet guiding plates is adjusted broader than the width of the sheet to be guided, and the distance actually adjusted may include irregularity.

Accordingly, in the case where the center line of the rectangular sheet does not coincide with that of the sheet conveying apparatus when the sheet is discharged from the printing machine, it is difficult to correct the position of the sheet by the sheet guiding plates so that the center line of the sheet coincides with that of the sheet conveying apparatus.

Suppose that, as illustrated in FIG. 6, the sheet 106 is fed into the sheet discharging apparatus 101 in such a manner that the center line L1 does not coincide with the center line L2. As illustrated in FIG. 7, two side edges of the sheet 106 are not positioned equally to the pair of the supporting means 112, respectively. That is, in FIG. 7, the right side edge of the sheet 106 insufficiently engages the right supporting means, but the left side edge of the sheet 106 sufficiently engages the left supporting means. Therefore, when the supporting means 112 rotate in the direction shown by arrows in the drawing, as illustrated in FIG. 8, the right side edge of the sheet 106 leaves the supporting means 112, thereby falling onto the receiving flap 115. Then, the left side edge of the sheet 106 engages the left supporting means 112. Accordingly, the sheet 106 inclines relative to the pair of the belts 114, 114, so that the sheet can not be appropriately passed from the supporting means to the belts.

An object of the present invention is to provide a sheet conveying apparatus capable of conveying the rectangular sheet in such a manner that the center line of the sheet coincides with a center line thereof for conveyance.

SUMMARY OF THE INVENTION

According to a first aspect of the present invention, a sheet conveying apparatus for conveying a rectangular sheet comprises conveying means for conveying the sheet while contacting a bottom surface of the sheet on a conveyance surface, and a pair of elastic members disposed on two sides of the conveying means, the elastic members guiding the sheet while contacting respective side edges of the sheet when the sheet is conveyed by the conveying means so that a center line of the sheet coincides with a center line for conveyance.

According to a second aspect of the present invention, a sheet conveying apparatus for conveying a rectangular sheet comprises conveying means for conveying the sheet while contacting a bottom surface of the sheet on a conveyance surface; a pair of guiding members disposed on two sides of the conveying means relative to a center line for conveyance, the guiding members being spaced apart from each other at a distance larger than a width of the sheet; and a pair of elastic members attached to the pair of guiding members respective, the elastic members guiding the sheet conveyed between the pair of guiding members while contacting the respective side edges of the sheet when the sheet is conveyed by the conveying means so that a center line of the sheet coincides with the center line for conveyance.

According to a sheet conveying apparatus as defined in a third aspect of the present invention, in the second aspect of the present invention, the pair of guiding members is arranged so that the distance decreases in a conveying direction of the sheet, and each elastic member is attached to a downstream side of the each guiding member in the conveying direction of the sheet.

According to a sheet conveying apparatus as defined in a fourth aspect of the present invention, in the third aspect of the present invention, the elastic member is a thin plate made of synthetic resin.

According to a sheet conveying apparatus as defined in a fifth aspect of the present invention, in the third aspect of the present invention, the conveying means comprises a pair of rollers, each roller having a rotating axis perpendicular to the center line for conveyance and located along the center line for conveyance; and at least one pair of belts connecting the pair of rollers respectively, the belts being arranged symmetrically about the center line for conveyance so that a distance thereof decreases in the conveying direction of the sheet.

According to a sheet conveying apparatus as defined in a sixth aspect of the present invention, in the fifth aspect of the present invention, the conveying means further comprises a center belt connecting the pair of rollers, and the center belt coincides with the center line for conveyance.

BRIEF DESCRIPTION OF THE DRAWINGS

FIG. 2(*b*) is a plan view showing conveyance of a sheet by a sheet conveying apparatus of the embodiment of the present invention;

FIG. 2(*c*) is a plan view showing conveyance of a sheet by a sheet conveying apparatus of the embodiment of the present invention; FIG. 2(*d*) is a plan view showing conveyance of a sheet by a sheet conveying apparatus of the embodiment of the present invention;

FIG. 2(*e*) is a plan view showing conveyance of a sheet by a sheet conveying apparatus of the embodiment of the present invention;

DETAILED DESCRIPTION OF PREFERRED EMBODIMENTS

A preferred embodiment of the present invention will be explained referring to FIGS. 1 and 2.

Figure 3:
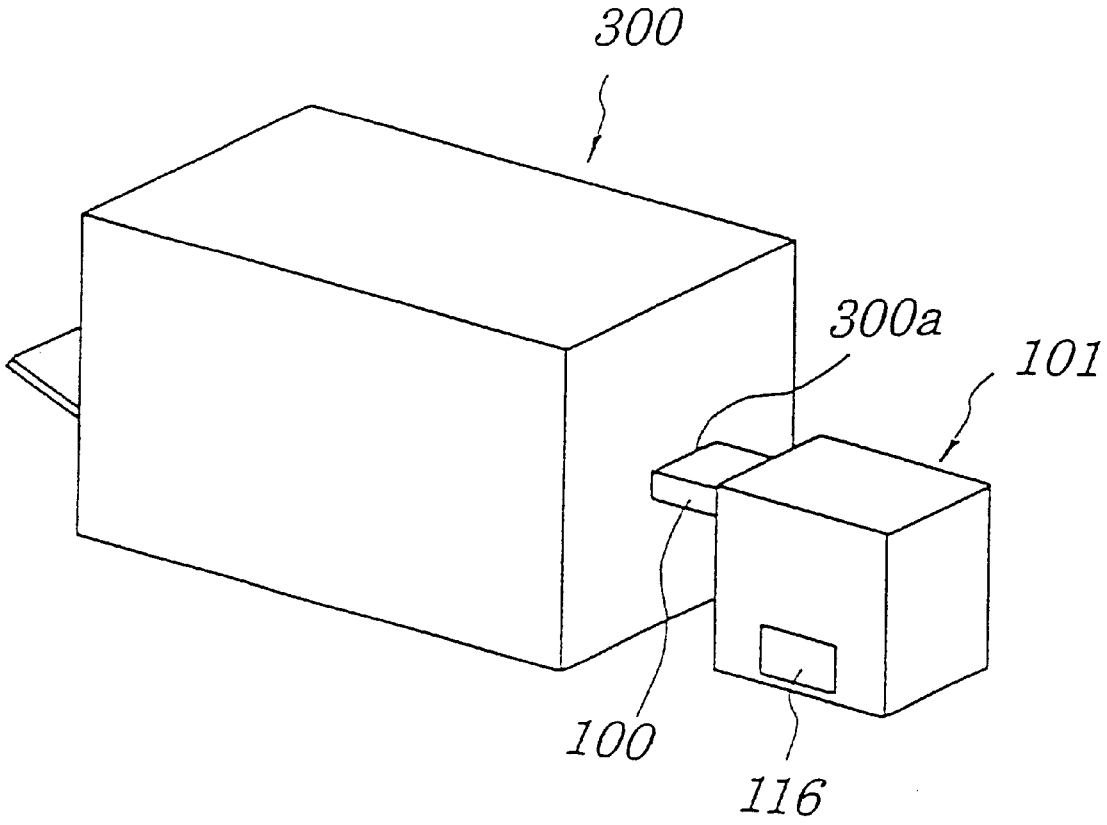
FIG. 3 is a perspective view showing a sheet discharging apparatus, a printing machine, and a sheet conveying apparatus, all of which has been proposed by the present applicant.
Figure 4:
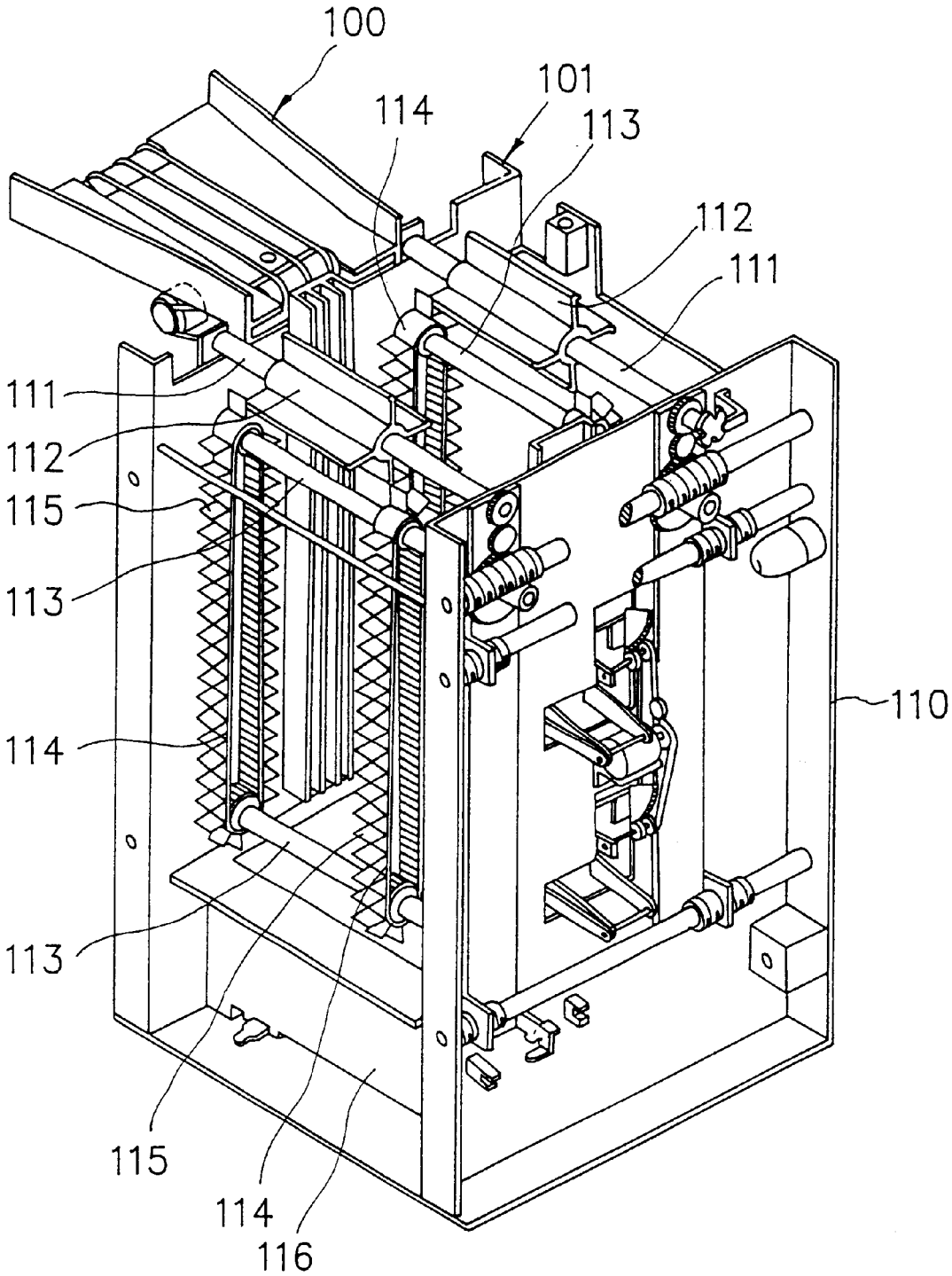
FIG. 4 is a perspective view of a sheet discharging apparatus with a sheet conveying apparatus attached thereto, which has been proposed by the present applicant.
Figure 5:
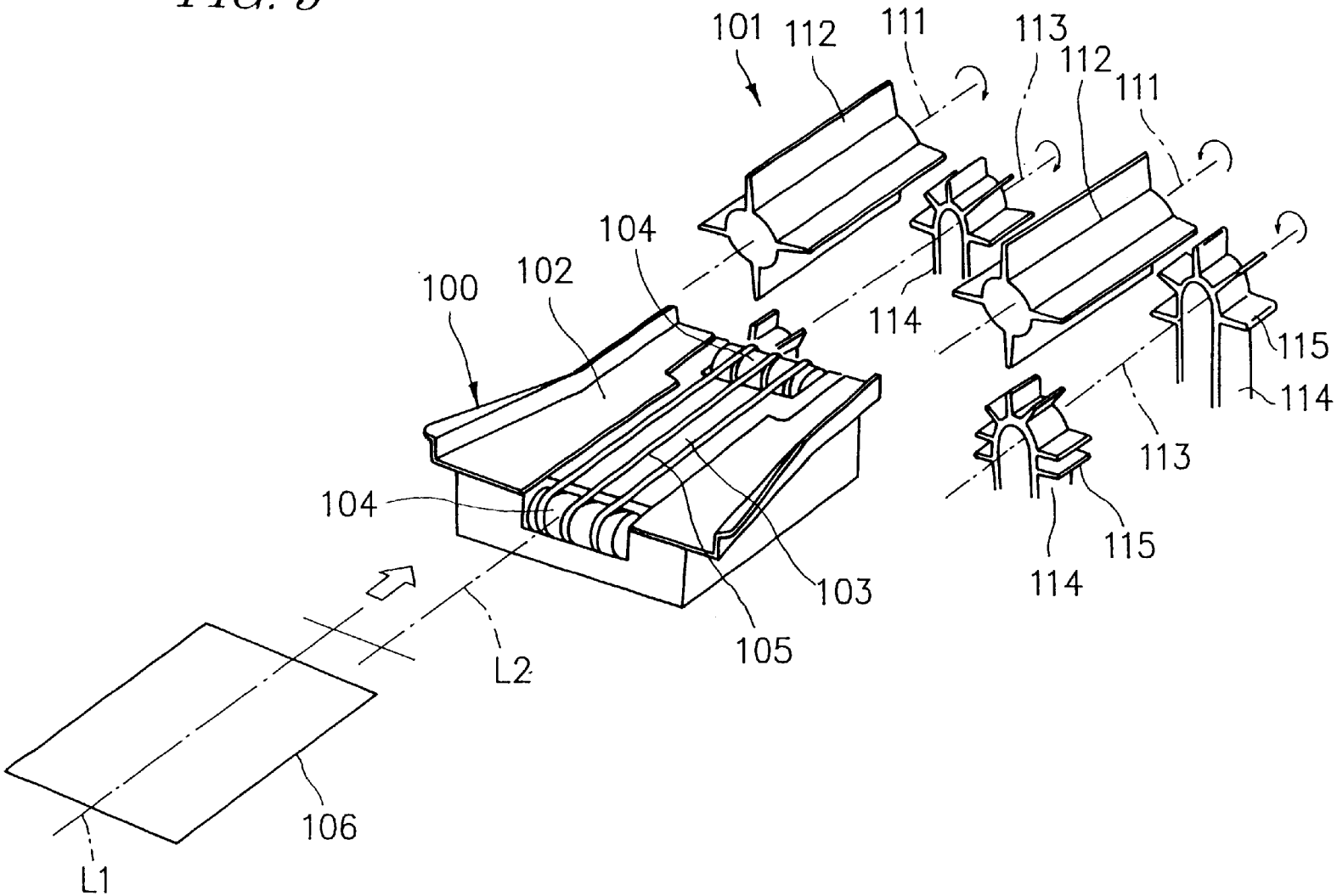
FIG. 5 is a perspective view of a part of a sheet discharging apparatus and a sheet conveying apparatus, which has been proposed by the present applicant.
Figure 6:
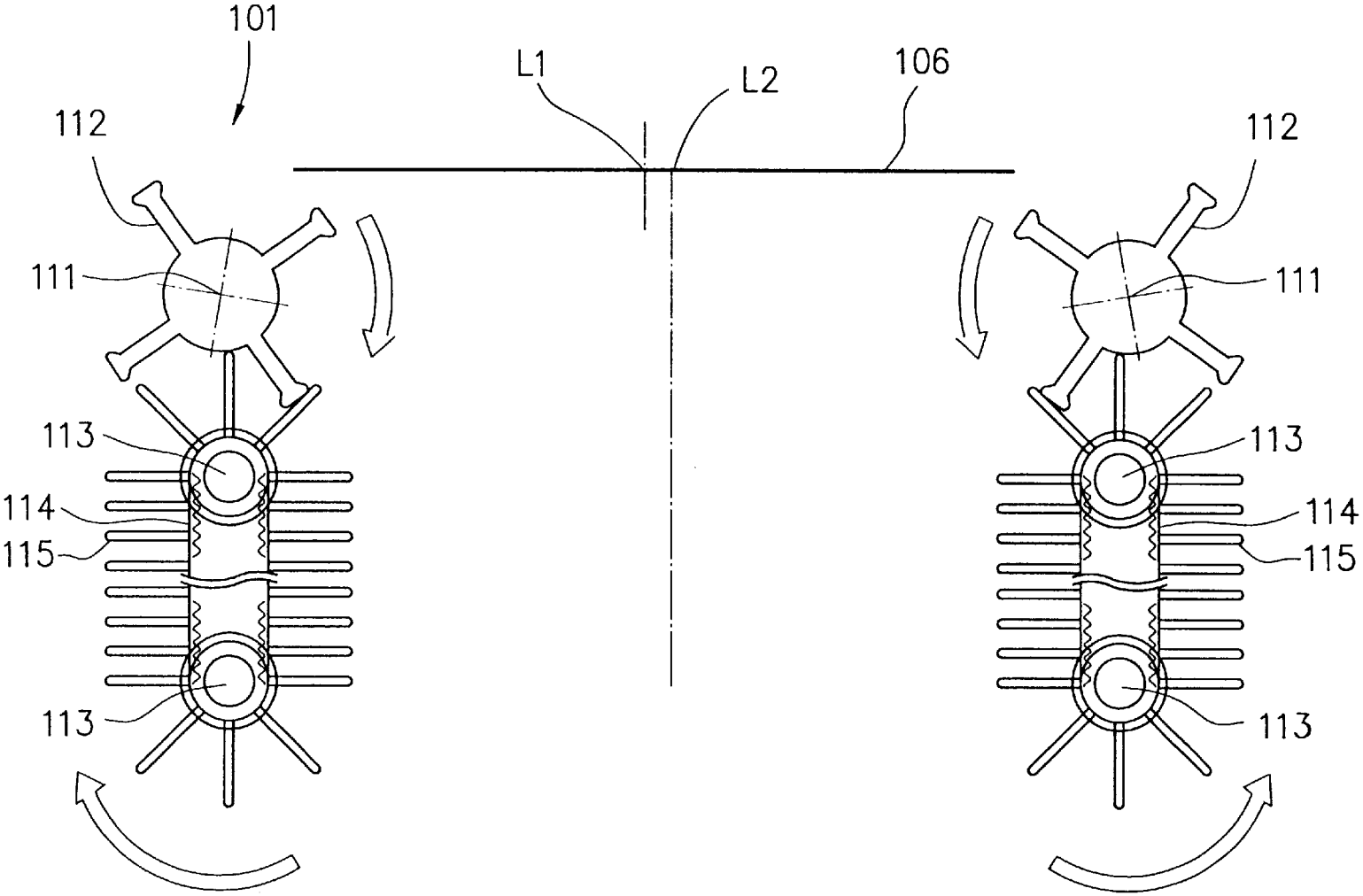
FIG. 6 is a view illustrating failure in sheet-conveyance conducted by a sheet conveying apparatus which has been proposed by the present applicant.
Figure 7:
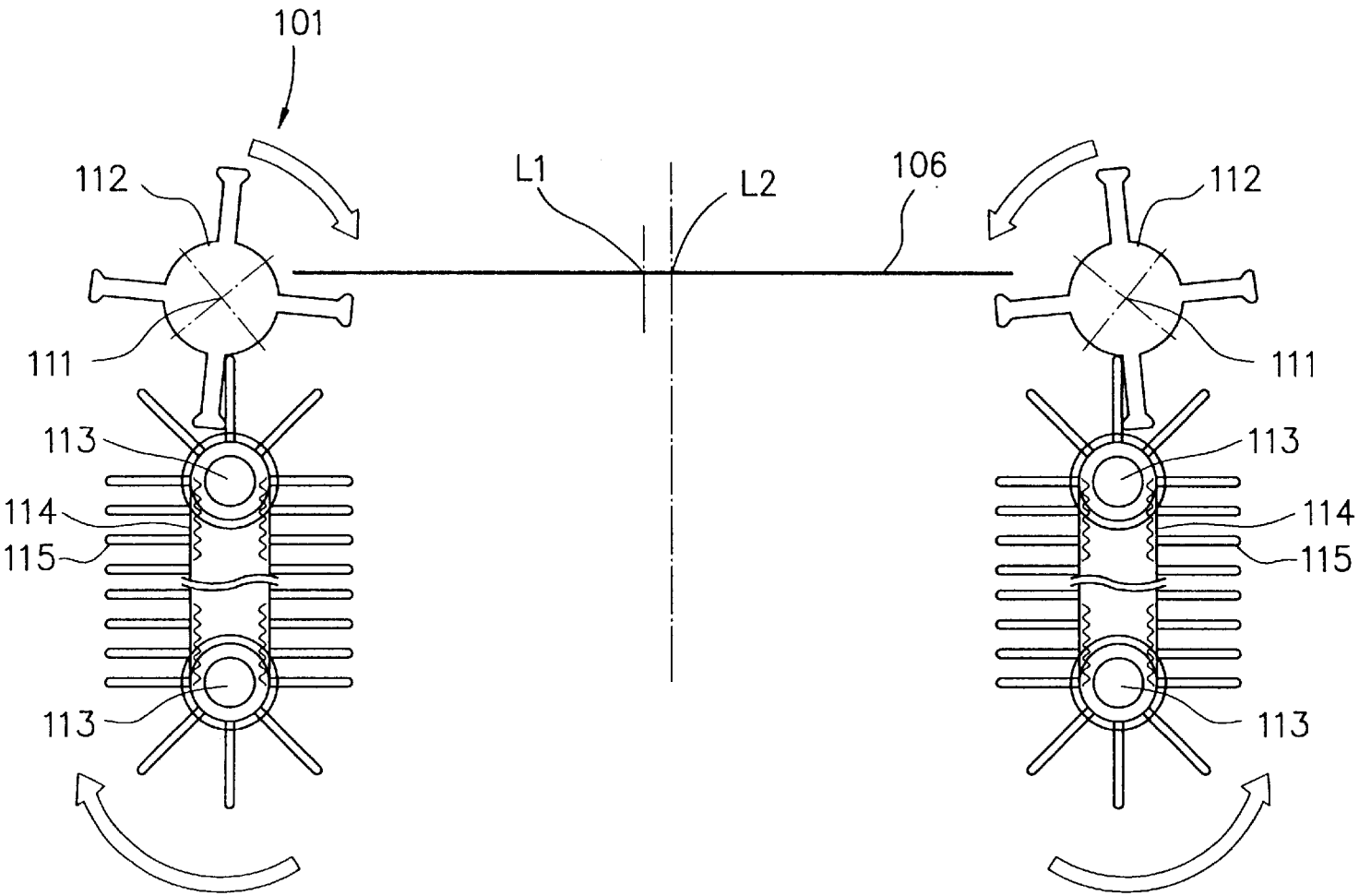
FIG. 7 is a view illustrating failure in sheet-conveyance conducted by a sheet conveying apparatus which has been proposed by the present applicant.
Figure 8:
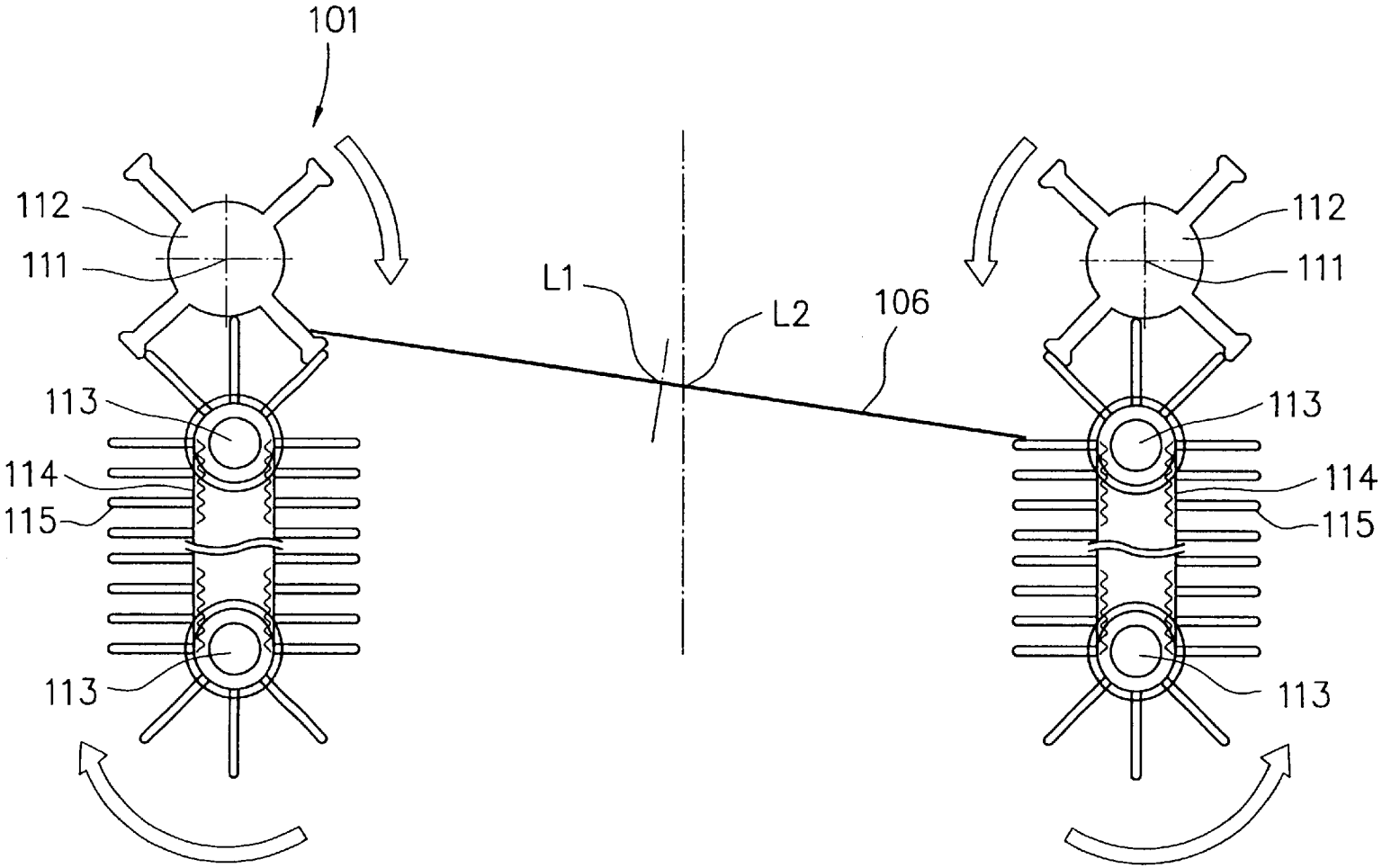
FIG. 8 is a view illustrating failure in sheet-conveyance conducted by a sheet conveying apparatus which has been proposed by the present applicant.

As the sheet conveying apparatus 100 illustrated in FIG. 3, the sheet conveying apparatus 1 of the embodiment is situated between the printing machine 300 and the sheet discharging apparatus 101. The sheet conveying apparatus 1 is used to convey a printed rectangular sheet 2 as discharged from the printing machine 300 into the sheet discharging apparatus 101.

Figure 1:
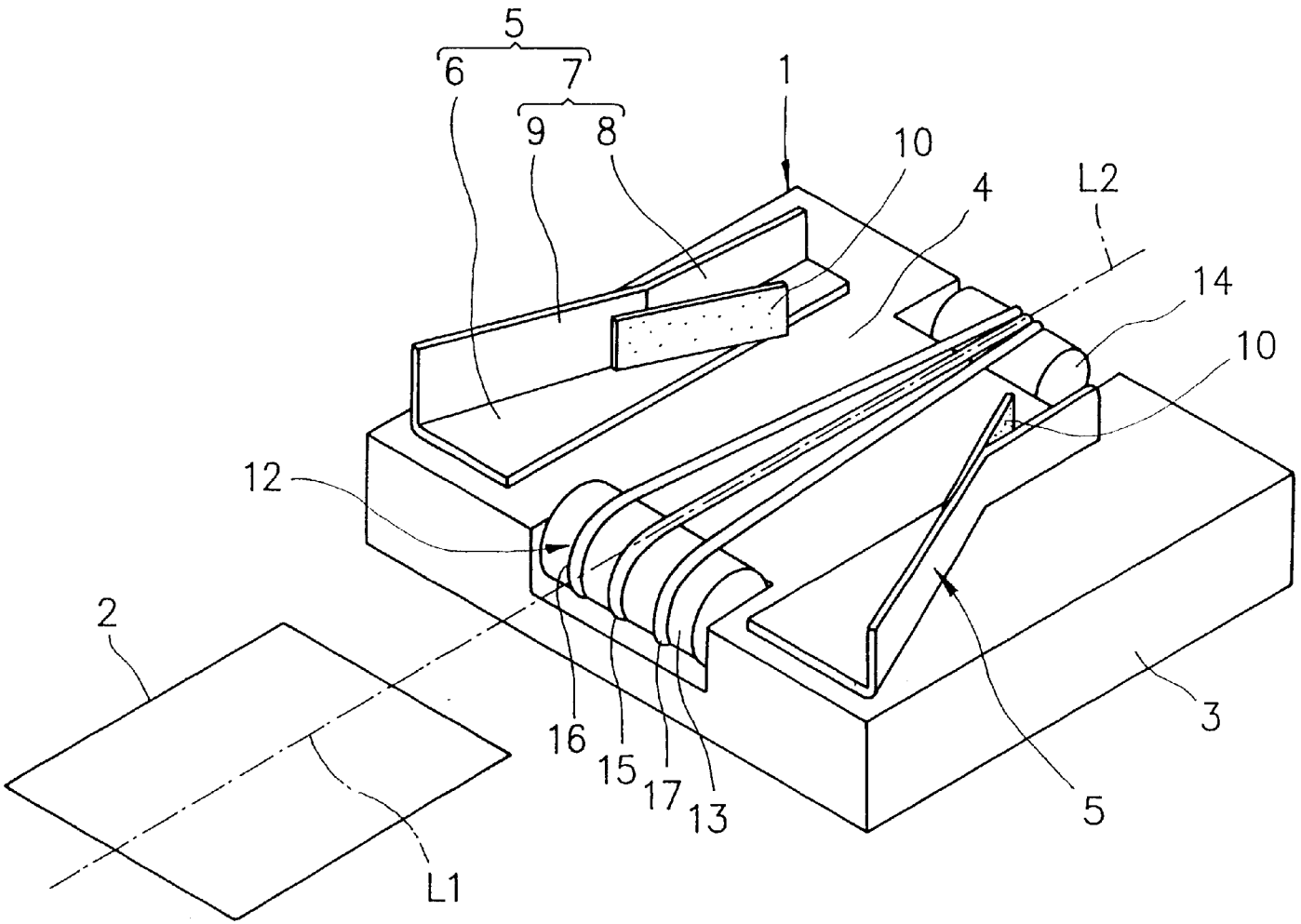
FIG. 1 is a perspective view of an embodiment of the present invention.
Figure 2B:
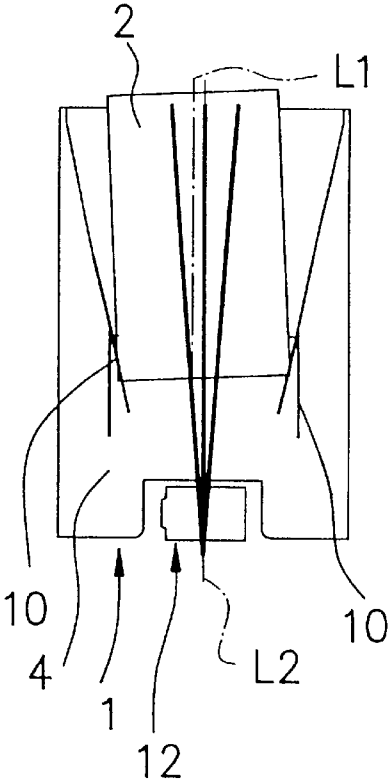
FIG. 2(*a*) is a plan view showing conveyance of a sheet by a sheet conveying apparatus of the embodiment of the present invention.
Figure 2A:
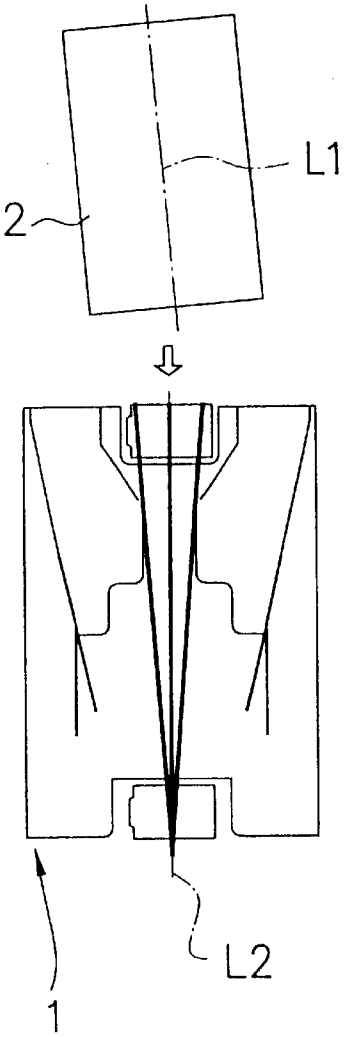
Figure 2E:
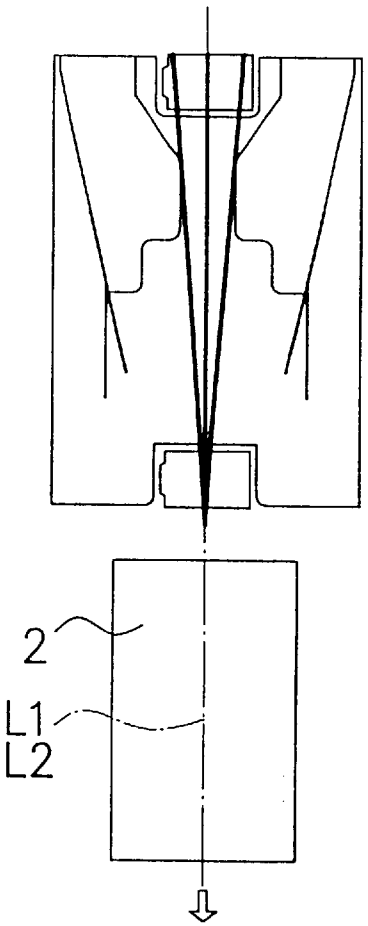
Figure 2D:
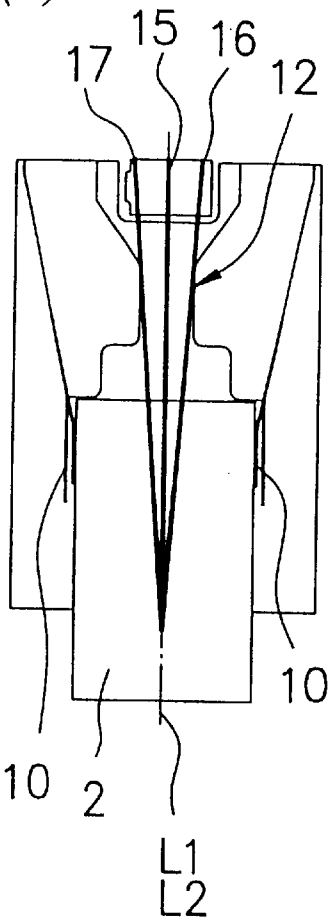
Figure 2C:
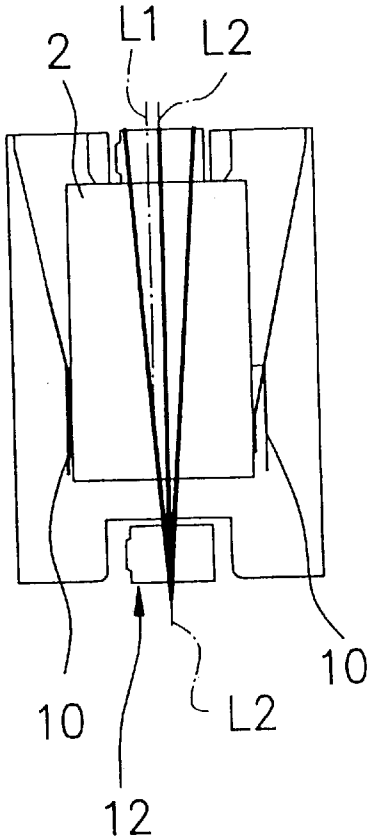

As illustrated in FIG. 1, an upper surface of a main body 3 of the apparatus is designed as a conveying surface 4 for conveying a rectangular printing sheet 2. A center line L2 for conveying the sheet 2 is supposed to be arranged on the conveying surface 4. The center line L2 for conveyance coincides with a center line of the sheet discharging apparatus 101 placed adjacent to the present apparatus. According to the present apparatus, the printing sheet 2 is conveyed in such a manner that the center line L1 of the sheet in a conveying direction coincides with the center line L2 for conveyance, and then regularly fed into the sheet discharging apparatus.

A pair of guiding plates 5 as guiding means is disposed on the conveying surface 4 of the main body 3. The pair of the guiding plates 5 is arranged symmetrically relative to the center line L2. The guiding plate 5 has a base plate 6 contacting the conveying surface 4 and a side plate 7 perpendicular to the base plate 6. The side plate 7 has a downstream plate 8 on a downstream side and an upstream plate 9 on an upstream side in the conveying direction. The downstream plate 8 is parallel to the center line L2 for conveyance. The upstream plate 9 inclines relative to the center line L2 with an upstream side thereof opened against the conveying direction. Accordingly, in the pair of the guiding plates 5, 5, the upstream plates 9, 9 are arranged to open toward the upstream side for easily receiving the printing sheet 2. Further, the pair of the guiding plates 5, 5 is movable on the conveying surface 4 and a distance therebetween is adjustable. In the present embodiment, the distance is to be adjusted fairly broader than a width of the printing sheet 2 to be printed.

An elastic sheet 10 as an elastic member is attached to a downstream side of the upstream plate 9. The elastic sheet 10 is a rectangular thin plate of synthetic resin. The elastic sheet 10 maintains a flat form while not having external force exerted thereon, thereby showing a flat surface approximately continuing from a flat surface of the upstream plate 9. Accordingly, a distance between leading ends, i.e. downstream sides of the elastic sheets is narrower than the width of the printing sheet 2. Thus, when the printing sheet 2 is inserted between the pair of the elastic sheets, the elastic sheets are elastically bent outwards, thereby holding respective side edges of the printing sheet 2, so that the sheet can move between the elastic sheets.

Conveying means 12 is placed in the main body 3. The conveying means 12 of the present embodiment functions in such a manner that it conveys the printing sheet 2 while contacting a bottom surface of the sheet on the conveyance surface 4, thereby allowing the center line L1 of the printing sheet 2 to coincide with the center line L2 for conveyance. Firstly, the conveying means 12 has a pair of rollers 13, 14. The pair of the rollers 13, 14 has rotating axes perpendicular to the center line L2 for conveyance, respectively. Center points of the pair of the rollers 13, 14 in directions of the rotating axes coincide with the center line L2 for conveyance, respectively. The pair of the rollers 13, 14 is connected by three belts 15, 16, and 17. Firstly, the belt 15 connects the pair of the rollers 13, 14 so that it coincides with the center line L2 for conveyance. Next, the two belts 16, 17 connect the pair of the rollers 13, 14 so that the belts are arranged symmetrically about the center line L2 for conveyance and a distance thereof decreases in the conveying direction of the printing sheet. That is, these two belts diagonally connect the pair of the rollers 13, 14, respectively, and the three belts 15, 16, and 17 meet on the roller 14 in the downstream side at a position that approximately coincides with the center line L2 for conveyance. Thus, in the sheet conveying apparatus 12 of the present embodiment, the three belts 13, 14, and 15 connect the pair of the rollers 13, 14 in such a manner that the belts come towards each other in the conveying direction and meet on the center line. Upper half portions of the three belts 15, 16, and 17 are placed in the conveying surface 4 of the main body 3. The three belts 15, 16, and 17 of the present embodiment are round belts. Flat belt is also applicable to the present invention. The belts are made of urethane that is proof against ink.

Operation will be explained in the constitution thus described.

As illustrated in FIG. 2(*a*), the printing sheet 2 as printed in the printing machine is fed into the sheet conveying apparatus 1. Then, the center line L1 of the printing sheet 2 in the conveying direction does not coincide with the center line L2 for conveyance in the sheet conveying apparatus 1, nor is parallel thereto.

As illustrated in FIG. 2(*b*), the printing sheet 2 is conveyed by the conveying means 12 along the conveying surface 4 of the sheet conveying apparatus 1. Two front corners of the printing sheet 2 meet a pair of the elastic sheets 10, 10, respectively.

As illustrated in FIG. 2(*c*), the printing sheet 2 is inserted between the pair of the elastic sheets 10, 10, while being conveyed by the conveying means 12. The elastic sheet 10 deforms outwards to contact the side edge of the printing sheet 2. Thus, the printing sheet 2 is held by the elastic sheets 10 at the two side edges thereof so that the center line L1 in the conveying direction is allowed to be approximately parallel to the center line L2 for conveyance. Namely, the printing sheet 2 is forced to be parallel to the center line L2 for conveyance, while being pushed by the elastic sheets 10 at the right and left sides thereof; however, at which time, the center line of the printing sheet 2 does not necessarily coincide with the center line L1 in the conveying direction.

As illustrated in FIG. 2(*d*), the printing sheet 2 is further conveyed by the conveying means 12 while being held parallel to the conveying direction by the two elastic sheets 10, 10. The conveying means 12 conveys the printing sheet 2 by using the three belts 15, 16, and 17 that converge on the center line for conveyance along the conveying direction. Thus, the printing sheet 2 is influenced by force acting in a direction such that the center line L1 of the printing sheet coincides with the center line L2 for conveyance. Accordingly, the printing sheet 2 is held parallel to the conveying direction by the elastic sheets 10 and conveyed so that the center line L1 of the printing sheet coincides with the center line L2 for conveyance.

As illustrated in FIG. 2(*e*), the printing sheet 2 is discharged in such a manner that the center line L1 of the printing sheet coincides with the center line L2 for conveyance. The printing sheet 2 as discharged from the present sheet conveying apparatus 1 can be appropriately supplied to the adjacent sheet discharging apparatus since the center line L2 of the present sheet conveying apparatus 1 is arranged to coincide with that of the sheet discharging apparatus. Accordingly, trouble such as conveyance failure of printing sheet does not occur in the sheet discharging apparatus.

In this way, according to the sheet conveying apparatus of the present embodiment, even in the case where the printing sheet 2 is irregularly supplied thereto, the printing sheet can be conveyed by the conveying means 12 having conveying force converging to the center line L2 in such a manner that the center line L1 of the printing sheet coincides with the center line L2, while being corrected to be parallel to the center line L2 by the elastic sheets 10. Accordingly, the printing sheet 2 can be conveyed to a next step in accordance with the predetermined center line L2.

In the present embodiment, elastic forces of the pair of the elastic sheets 10, 10 are determined to be identical to each other. However, even if the forces of the two elastic sheets are different from each other, the printing sheet 2 can be held parallel to the center line L2; but, the distance between the center line L1 and the center line L2 is otherwise. Also, in this state, if the printing sheet is conveyed by the conveying means comprising the converging belts, the center line L1 of the printing sheet 2 can finally coincide with the center line L1 for conveyance.

In the present embodiment, the conveying means 12 has the three belts 15, 16 and 17 converging to each other, but the total number of the belts is not restricted to three. For example, the two belts 16 and 17 without the center belt 15 can also perform the same conveyance function. Further, the number of the belts diagonally arranged relative to the center belt 15 may be two rather than one on each side of the center line. In this case, the total number of the belts should be five. Of course, the total number of the belts may be beyond five.

In short, the conveying means of the present embodiment should be such that it can converge the printing sheet 2 to the center line L2 for conveyance while conveying the same. For example, if we suppose intersection points where the belts and a line perpendicular to the conveyance direction intersect on the conveyance surface 4, composition of vectors of the belts at the intersection points should coincide with the conveyance direction.

The conveying means of the present invention is not restricted to a mechanism by rollers and belts on condition that it can exert such conveying force.

In the present embodiment, the elastic sheet 10 of a thin synthetic plate is described as an elastic member. However, other materials with elasticity can be adopted. For example, a thin metal plate is also useful.

According to the present invention, the elastic member makes the center line of the printing sheet to be parallel to the center line for conveyance, the conveying means conveys the printing sheet by conveying force converging to the center line for conveyance, so that the center line of the printing sheet can coincide with the center line for conveyance.

Thus, even in the case where the printing sheet is irregularly supplied to the sheet conveying apparatus, the printing sheet can be conveyed to the next step after being precisely positioned to the center line for conveyance. Particularly, the present apparatus is effective for an apparatus that needs a printing sheet to be supplied thereto in accordance with a center line thereof. For example, this corresponds to the case as described before, where the conveyance failure occurs at the sheet discharging apparatus because of displacement of the center line of the printing sheet relative to the apparatus. For further example, in a multi-color printing machine, the present invention is also effective in a case where a printing sheet printed in a first color is conveyed to a next step for printing in a second color.

What is claimed is:

1. A sheet conveying apparatus for conveying a rectangular sheet, comprising:

conveying means for conveying said sheet while contacting a bottom surface of said sheet on a conveyance surface thereof, said conveying means including a pair of rollers, each having a rotating axis perpendicular to a center line for conveyance and located along the center line for conveyance, and at least one pair of belt, connecting the pair of rollers respectively, said belts being arranged symmetrically about the center line for conveyance so that a distance thereof decreases in a conveying direction of the sheet, and a pair of elastic members disposed on two sides of said conveying means, said elastic members guiding said sheet while contacting respective side edges of said sheet when said sheet is conveyed by said conveying means so that a center line of said sheet coincides with the center line for conveyance.

2. A sheet conveying apparatus for conveying a rectangular sheet, comprising:

conveying means for conveying said sheet while contacting a bottom surface of said sheet on a conveyance surface thereof, said conveying means including a pair of rollers, each having a rotating axis perpendicular to a center line for conveyance and located along the center line for conveyance, and at least one pair of belts connecting the pair of rollers respectively, said belts being arranged symmetrically about the center line for conveyance so that a distance thereof decreases in a conveying direction of the sheet, a pair of guiding members disposed on two sides of said conveying means relative to the center line for conveyance, said guiding members being spaced apart from each other at a distance larger than a width of said sheet, and a pair of elastic members attached to said pair of guiding members respectively, said elastic members guiding said sheet conveyed between said pair of guiding members while contacting respective side edges of said sheet when said sheet is conveyed by said conveying means so that a center line of said sheet coincides with said center line for conveyance.

3. A sheet conveying apparatus as claimed in claim 2, wherein said pair of guiding members is arranged so that said distance decreases in the conveying direction of said sheet, said elastic members being attached to respective downstream sides of the guiding members in the conveying direction of said sheet.

4. A sheet conveying apparatus as claimed in claim 3, wherein said elastic member is a thin plate made of synthetic resin.

5. A sheet conveying apparatus as claimed in claim 2, wherein said conveying means further comprises a center belt connecting said pair of rollers, said center belt coinciding with said center line for conveyance.

* * * * *

UNITED STATES PATENT AND TRADEMARK OFFICE

CERTIFICATE OF CORRECTION

PATENT NO. : 6,296,248 B1
DATED : October 2, 2001
INVENTOR(S) : Yoshitaka Tanaka It is certified that error appears in the above-identified patent and that said Letters Patent is hereby corrected as shown below:

Title page,
Item [73], Assignee's name, change "Rico Kagaku Corporation" to -- Riso Kagaku Corporation --.

Signed and Sealed this

Fifth Day of March, 2002

*Attest:*

*Attesting Officer*

JAMES E. ROGAN
*Director of the United States Patent and Trademark Office*